US009564267B2

(12) United States Patent
Lin et al.

(10) Patent No.: US 9,564,267 B2
(45) Date of Patent: Feb. 7, 2017

(54) MAGNETIC ELEMENT AND BOBBIN ASSEMBLY THEREOF

(71) Applicant: DELTA ELECTRONICS, INC., Taoyuan Hsien (TW)

(72) Inventors: Hua-Sheng Lin, Taoyuan Hsien (TW); Hsin-Wei Tsai, Taoyuan Hsien (TW); Yu-Liang Hung, Taoyuan Hsien (TW); Ming-Cheng Lee, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 100 days.

(21) Appl. No.: 14/603,170

(22) Filed: Jan. 22, 2015

(65) Prior Publication Data

US 2016/0133379 A1 May 12, 2016

(30) Foreign Application Priority Data

Nov. 6, 2014 (CN) ..... 2014 1 0620951

(51) Int. Cl.

| | |
|---|---|
| ***H01F 27/24*** | (2006.01) |
| ***H01F 27/32*** | (2006.01) |
| ***H01F 27/30*** | (2006.01) |
| ***H01F 27/29*** | (2006.01) |
| *H01F 27/28* | (2006.01) |

(52) U.S. Cl.

CPC ..... *H01F 27/325* (2013.01); *H01F 27/24* (2013.01); *H01F 27/29* (2013.01); *H01F 27/30* (2013.01); *H01F 27/303* (2013.01); *H01F 27/306* (2013.01); *H01F 27/2871* (2013.01)

(58) Field of Classification Search

CPC ..... H01F 27/00–27/30

USPC ..... 336/65, 83, 90, 92, 192, 196, 198,336/220–223

See application file for complete search history.

(56) References Cited

U.S. PATENT DOCUMENTS

| | | | | |
|---|---|---|---|---|
| 2,355,477 | A * | 8/1944 | Stahl | H01F 41/098 242/118.7 |
| 3,605,055 | A * | 9/1971 | Grady | G01R 11/02 242/118.41 |
| 7,154,366 | B2 * | 12/2006 | Hsueh | H01F 5/02 336/198 |
| 7,218,198 | B2 * | 5/2007 | Pilniak | H01F 5/02 336/198 |
| 7,859,380 | B2 * | 12/2010 | Hasenour | H01F 5/02 336/198 |

(Continued)

*Primary Examiner* — Tuyen Nguyen

(74) *Attorney, Agent, or Firm* — Kirton McConkie; Evan R. Witt

(57) ABSTRACT

A magnetic element includes a bobbin assembly, at least one pancake winding assembly, a winding coil assembly and a magnetic core assembly. The bobbin assembly includes plural bobbin units. The plural bobbin units are detachably coupled with each other. Each bobbin unit includes a main body, a coupling structure and at least one engaging structure. The main body includes an external surface, a channel and a first winding section. The coupling structure is disposed on the external surface of the main body. The engaging structure of the bobbin unit is engaged with the engaging structure of an adjacent bobbin unit. The pancake winding assembly is disposed around the main body and coupled with the corresponding coupling structure. The winding coil assembly is wound around the first winding section. The magnetic core assembly is partially accommodated within the channel of the bobbin unit.

27 Claims, 14 Drawing Sheets

(56) References Cited

U.S. PATENT DOCUMENTS 8,922,320 B2 * 12/2014 Eom ..... H01F 27/325
336/192

* cited by examiner

31

2

MAGNETIC ELEMENT AND BOBBIN ASSEMBLY THEREOF

TECHNICAL FIELD

The present disclosure relates to a magnetic element, and more particularly to a magnetic element with an increased winding space as well as a bobbin assembly of the magnetic element.

BACKGROUND OF THE DISCLOSURE

A transformer is a magnetic device that transfers electric energy from one circuit to another circuit through coils in order to regulate an input voltage to a desired range for powering an electronic device.

FIG. 1 is a schematic exploded view illustrating a conventional transformer. As shown in FIG. 1, the conventional transformer 1 comprises a bobbin 11, a magnetic core assembly 12, a primary winding assembly 13 and at least one pancake winding assembly 14. The primary winding assembly 13 and the pancake winding assembly 14 are disposed around the bobbin 11. The pancake winding assembly 14 is used as a secondary winding assembly. The magnetic core assembly 12 is partially accommodated within a channel 111 of the bobbin. During operations of the transformer, an input voltage is inputted into the primary winding assembly 13, the magnetic core assembly is subject to electromagnetic induction, and a regulated voltage is outputted from the pancake winding assembly 14.

Generally, the pancake winding assembly 14 of the conventional transformer 1 is implemented by one or more copper foil sheets. The bobbin 11 comprises a channel 111, a main body 112, two lateral plates 113 and plural partition plates 114. The two lateral plates 113 are located at two opposite sides of the main body 112. The plural partition plates 114 are disposed on the main body 112. Moreover, an accommodation space 115 is formed between every two partition plates 114 for accommodating the pancake winding assembly 14. The primary winding assembly 13 is wound around a winding accommodation space 116 between the plural partition plates 114 and the main body 112. Since the partition plate 114 has a specified thickness, a portion of the winding space of the bobbin 11 is occupied by the partition plate 114. Under this circumstance, the overall volume of the conventional transformer 1 is large. Moreover, for expanding the bobbin 11, it is necessary to produce a new mold of the bobbin with a corresponding size. Since the expansion of the bobbin 11 increases the fabricating cost of the transformer 1, the expansibility of the bobbin 11 is limited.

Please refer to FIG. 1 again. The pancake winding assembly 14 further comprises two extension parts 141. The primary winding assembly 13 in one winding accommodation space 116 may cross over one of the extension parts 141 to the adjacent winding accommodation space 116. Moreover, the extension part 141 further comprises an indentation 141*a* for assisting in positioning the fly line of the primary winding assembly 13. However, since the pancake winding assembly 14 is a combination of plural ring-shaped metallic sheets, the arrangement of the extension parts 141 may increase the complexity of forming the pancake winding assembly 14 and result in lot of metal scrap during the fabricating process. Moreover, since pancake winding assembly 14 is produced by welding the plural ring-shaped metallic sheets, the fabricating cost of the pancake winding assembly 14 is very high. Moreover, after the transformer 1 is assembled, the tightness between the primary winding assembly 13, the pancake winding assembly 14, the magnetic core assembly 12 and the bobbin 11 is possibly insufficient. Consequently, the applications of the conventional transformer 1 are limited.

SUMMARY OF THE DISCLOSURE

An object of the present disclosure provides a magnetic element and a bobbin assembly thereof, in which the bobbin assembly has no partition plates. Consequently, the winding space of the bobbin assembly is increased, and the fabricating cost and the overall volume of the magnetic element are both reduced.

Another object of the present disclosure provides a magnetic element and a bobbin assembly thereof, in which every two adjacent bobbin units of the bobbin assembly are combined together according to the engagement between corresponding engaging structures. Consequently, the length of the bobbin assembly is extensible according to the practical requirements.

A further object of the present disclosure provides a magnetic element and a bobbin assembly thereof, in which a fixing device of the bobbin assembly is used for assisting in crossing over the winding coil assembly, fixing the fly lines of the winding coil assembly, reducing the fabricating cost of the pancake winding assembly and stabilizing the overall structure of the magnetic element.

In accordance with an aspect of the present disclosure, there is provided a bobbin assembly for a magnetic element. The magnetic element includes at least one pancake winding assembly. The bobbin assembly includes plural bobbin units. The plural bobbin units have no winding accommodation spaces. The plural bobbin units are detachably coupled with each other. Each of the plural bobbin units includes a main body, a coupling structure and at least one engaging structure. The main body includes an external surface, a channel running through the main body, a first lateral part, a second lateral part opposed to the first lateral part, and a first winding section between the first lateral part and the second lateral part. The coupling structure is disposed on the external surface of the main body. The at least one pancake winding assembly is disposed around the main body of the corresponding bobbin unit. The at least one pancake winding assembly is coupled with the corresponding coupling structure. The engaging structure of the bobbin unit is engaged with the engaging structure of an adjacent bobbin unit.

In accordance with another aspect of the present disclosure, there is provided a magnetic element. The magnetic element includes a bobbin assembly, at least one pancake winding assembly, at least one winding coil assembly, and a magnetic core assembly. The bobbin assembly includes plural bobbin units. The plural bobbin units have no winding accommodation spaces. The plural bobbin units are detachably coupled with each other. Each of the plural bobbin units includes a main body, a coupling structure and at least one engaging structure. The main body includes an external surface, a channel running through the main body, a first lateral part, a second lateral part opposed to the first lateral part, and a first winding section between the first lateral part and the second lateral part. The coupling structure is disposed on the external surface of the main body. The engaging structure of the bobbin unit is engaged with the engaging structure of an adjacent bobbin unit. The at least one pancake winding assembly is disposed around the main body of the corresponding bobbin unit, wherein the at least one pancake winding assembly is coupled with the corresponding coupling structure. The at least one winding coil assembly is wound around the first winding section. The magnetic core assembly is partially accommodated within the channel of the bobbin unit.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 2:
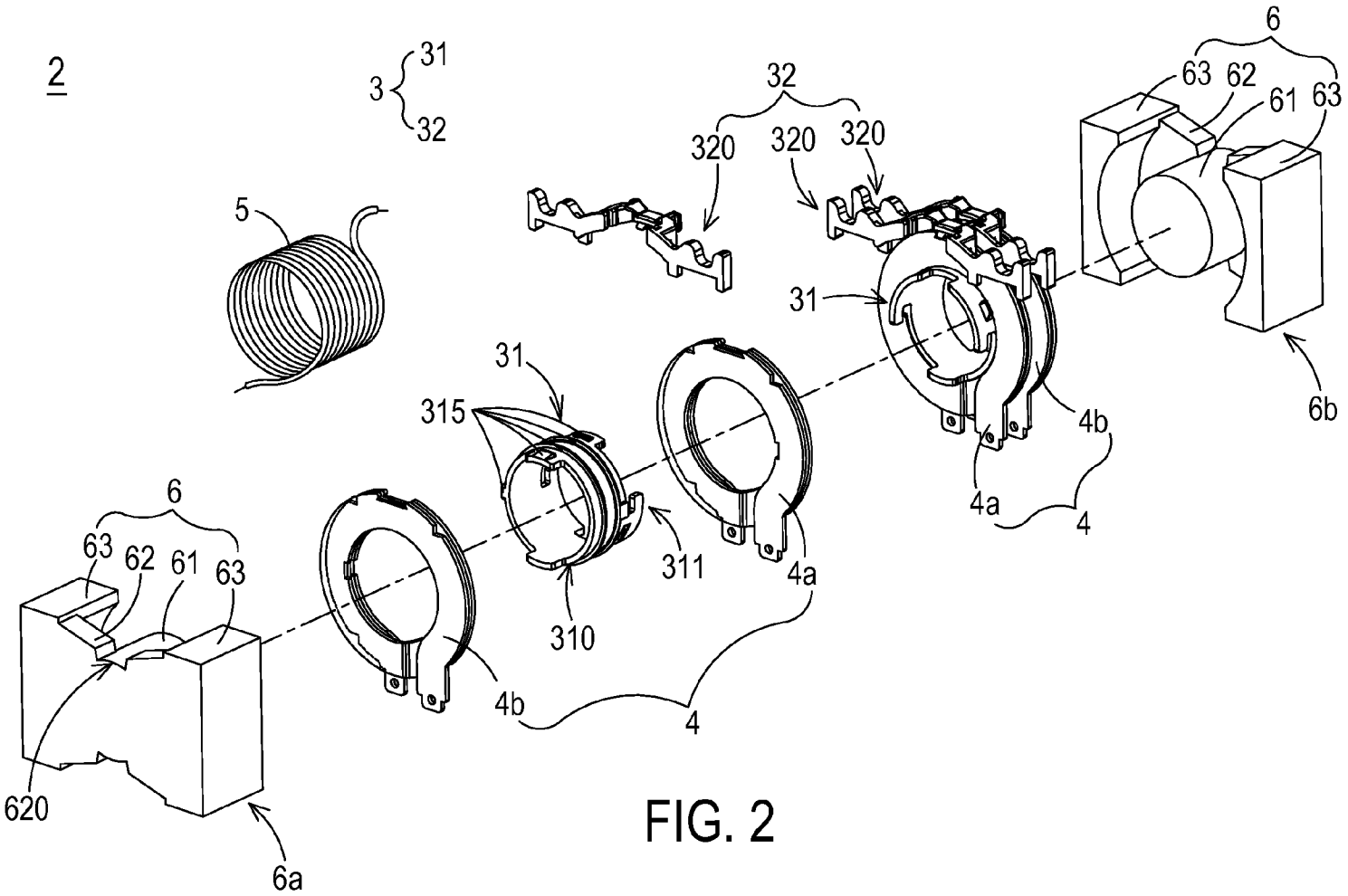
FIG. 2 is a schematic exploded view illustrating a magnetic element according to an embodiment of the present disclosure.
Figure 3A:
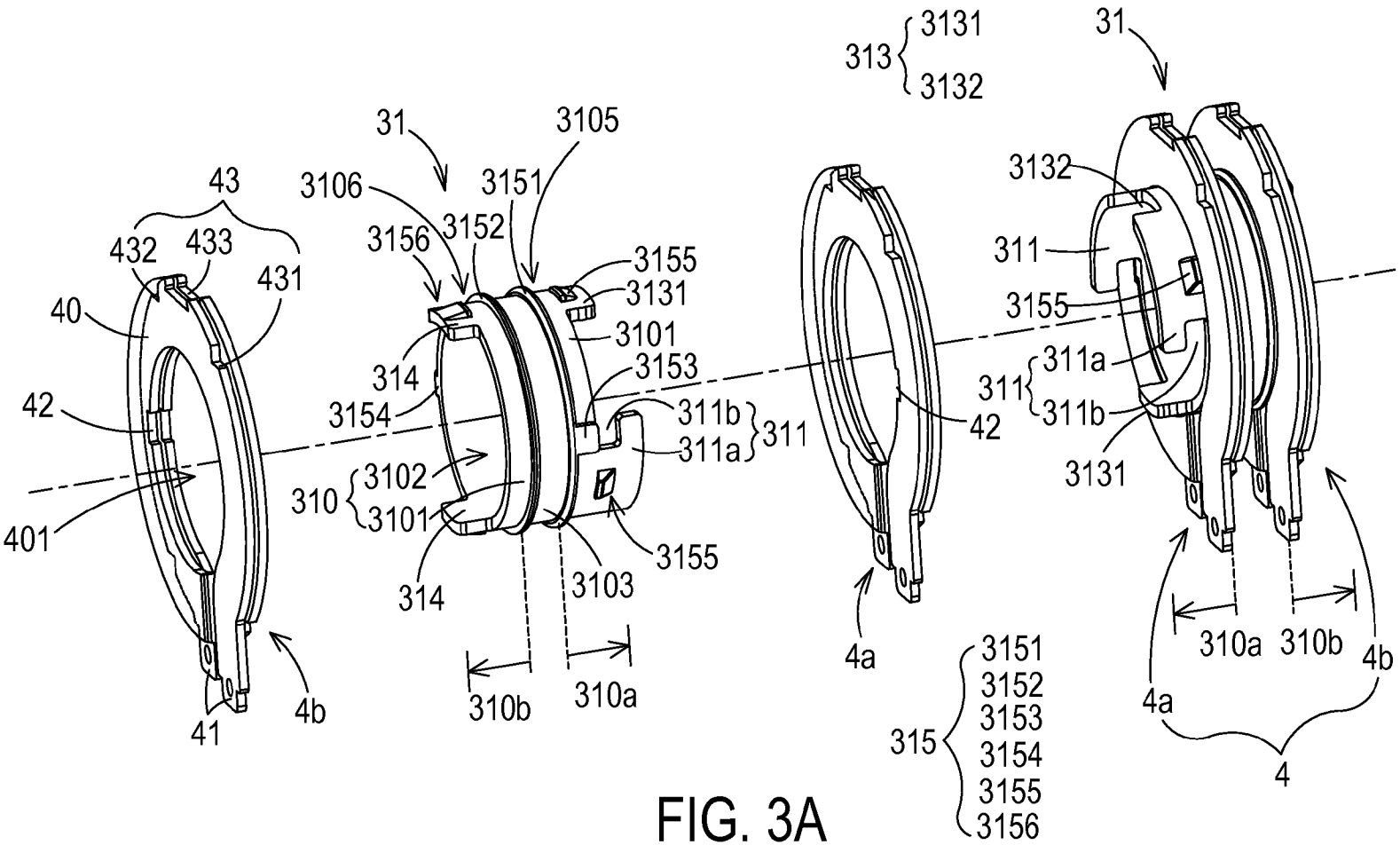
FIG. 3A is a schematic exploded view illustrating the relationship between a bobbin unit and a primary winding assembly of the magnetic element of FIG. 2.

FIG. 2 is a schematic exploded view illustrating a magnetic element according to an embodiment of the present disclosure. FIG. 3A is a schematic exploded view illustrating the relationship between a bobbin unit and a primary winding assembly of the magnetic element of FIG. 2. The magnetic element 2 comprises a bobbin assembly 3, at least one pancake winding assembly 4, at least one winding coil assembly 5 and a magnetic core assembly 6. The bobbin assembly 3 comprises plural bobbin units 31. Each of the bobbin unit 31 has no winding accommodation space itself. The plural bobbin units 31 are detachably coupled with each other. Each of the bobbin units 31 comprises a main body 310, at least one engaging structure 311 and a coupling structure 315. The main body 310 has an external surface 3101 and a channel 3102. The main body 310 comprises a first winding section 3103. The channel 3102 runs through the main body 310. The coupling structure 315 is disposed on the external surface 3101 of the main body 310. The bobbin unit 31 is coupled with the pancake winding assembly 4 via the coupling structure 315. The engaging structure 311 of the bobbin unit 31 may be engaged with the engaging structure 311 of an adjacent bobbin unit 31. The pancake winding assembly 4 is disposed around the main body 310 of the bobbin unit 31 and coupled with the coupling structure 315. Moreover, the winding coil assembly 5 is wound around the first winding section 3103. The magnetic core assembly 6 is partially accommodated within the channel 3102 of the bobbin unit 31. In some other embodiment, the bobbin assembly 3 further comprises a fixing device 32 for assisting in fixing the fly line of the winding coil assembly 5. The detailed structure of the magnetic element 2 will be illustrated in more details as follows.

In this embodiment, the main body 310 of the bobbin unit 31 has a cylindrical structure with the external surface 3101 and the channel 3102. The coupling structure 315 comprises a first ring-shaped rib 3151 and a second ring-shaped rib 3152. The first ring-shaped rib 3151 and the second ring-shaped rib 3152 are arranged around the external surface 3101 of the main body 310 and in parallel with each other. In this embodiment, the first ring-shaped rib 3151 and the second ring-shaped rib 3152 are slightly protruded from the external surface 3101 of the main body 310. By the first ring-shaped rib 3151 and the second ring-shaped rib 3152, the external surface 3101 of the main body 310 is divided into a first lateral part 310*a*, a second lateral part 310*b* and the first winding section 3103. In particular, the first winding section 3103 is arranged between the first ring-shaped rib 3151 and the second ring-shaped rib 3152. Consequently, the winding coil assembly 5 may be wound around the first winding section 3103. The first lateral part 310*a* and the second lateral part 310*b* are located at two opposite sides of the first winding section 3103. That is, the first winding section 3103 is arranged between the first lateral part 310*a* and the second lateral part 310*b*.

Figure 3B:
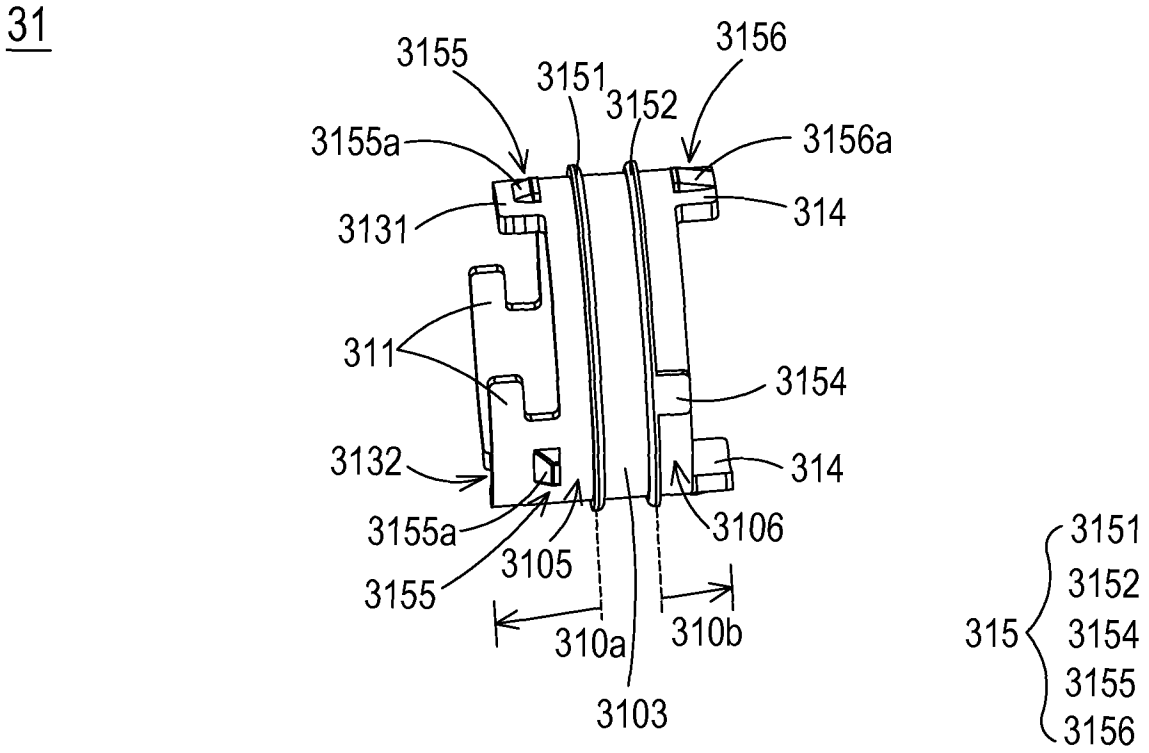
FIG. 3B is a schematic side view illustrating the bobbin unit of the magnetic element as shown in FIG. 3A and taken along another viewpoint.

FIG. 3B is a schematic side view illustrating the bobbin unit of the magnetic element as shown in FIG. 3A and taken along another viewpoint. Please refer to FIGS. 3A and 3B. In this embodiment, the engaging structure 311 is located at the first lateral part 310*a* of the main body 310, and comprises a protrusion 311*a* and a notch 311*b*. Alternatively, in some other embodiments, the bobbin unit 31 comprises two engaging structures 311, which are respectively located at the first lateral part 310*a* and the second lateral part 310*b* of the main body 310. An example of the engaging structure 311 includes but is not limited to a hook. Consequently, the engaging structure 311 of the bobbin unit 31 may be engaged with the engaging structure 311 of an adjacent bobbin unit 31. For assembling the bobbin assembly 3, the first lateral parts 310*a* of two adjacent bobbin units 31 are firstly aligned with each other, and then the protrusion 311*a* and the notch 311*b* of the engaging structure 311 of the bobbin unit 31 are engaged with the notch 311*b* and the protrusion 311*a* of the engaging structure 311 of the adjacent bobbin unit 31. Due to the engagement between the engaging structures 311 of the two bobbin units 31, the bobbin assembly 3 is assembled. For extending the length of the bobbin assembly 3, the bobbin assembly 3 may comprise more bobbin units 31. It is noted that the type and number of the engaging structures 311 may be varied according to the practical requirements.

Moreover, the bobbing unit 31 further comprises at least one guiding structure 313. The at least one guiding structure 313 is located at the first lateral parts 310 of the main body 310 for assisting in the combination of the plural bobbin units 31. In this embodiment, the at least one guiding structure 313 comprises a first guiding structure 3131 and a second guiding structure 3132. The first guiding structure 3131 and the second guiding structure 3132 are located at the first lateral part 310*a* of the main body 310 and opposed to each other. Moreover, the first guiding structure 3131 and the second guiding structure 3132 have complementary shapes. It is noted that the number and shapes of the first guiding structure 3131 and the second guiding structure 3132 are not restricted. For example, the first guiding structure 3131 and the second guiding structure 3132 may be designed as a convex structure and a concave structure, respectively. In this embodiment, for combining two bobbin units 31 together, the first guiding structure 3131 and the second guiding structure 3132 of the bobbin unit 31 are respectively coupled with the second guiding structure 3132 and the first guiding structure 3131 of the adjacent bobbin unit 31. In other words, the arrangements of the first guiding structure 3131 and the second guiding structure 3132 can guide the quick combination of the plural bobbin units 31, so that the process of assembling the bobbin assembly 3 is simplified. It is noted that numerous modifications and alterations may be made while retaining the teachings of the disclosure. For example, in some other embodiments, the first guiding structure 3131 is located at the first lateral part 310*a* of the main body 310, and the second guiding structure 3132 is located at the second lateral part 310*b* of the main body 310. In some other embodiments, the bobbin unit 31 further comprises at least one position-limiting structure 314. The at least one position-limiting structure 314 is protruded from a top side or/and a bottom side of the second lateral part 310*b*. The position-limiting structure 314 is used for guiding the connection between the bobbin unit 31 and the magnetic core assembly 6, and the position-limiting structure 314 is also used for positioning the magnetic core assembly 6. It is noted that configuration and arrangement of the position-limiting structure 314 are not restricted.

Please refer to FIGS. 3A and 3B. The coupling structure 315 is configured to be coupled with the pancake winding assembly 4. The coupling structure 315 comprises the first ring-shaped rib 3151, the second ring-shaped rib 3152, a first locking part 3153, a second locking part 3154, at least one first bulge 3155 and at least one second bulge 3156. The first locking part 3153 is located at the first lateral part 310*a* of the main body 310 and arranged beside the first ring-shaped rib 3151. The second locking part 3154 is located at the second lateral part 310*b* of the main body 310 and arranged beside the second ring-shaped rib 3152. The first locking part 3153 or the second locking part 3154 is engaged with a corresponding locking recess 42 of the pancake winding assembly 4. In this embodiment, the first locking part 3153 and the second locking part 3154 are rectangular tabs, which are slightly protruded from the external surface 3101 of the main body 310. Consequently, the winding space of the bobbing assembly 3 is not hindered by the first locking part 3153 and the second locking part 3154.

Figure 3C:
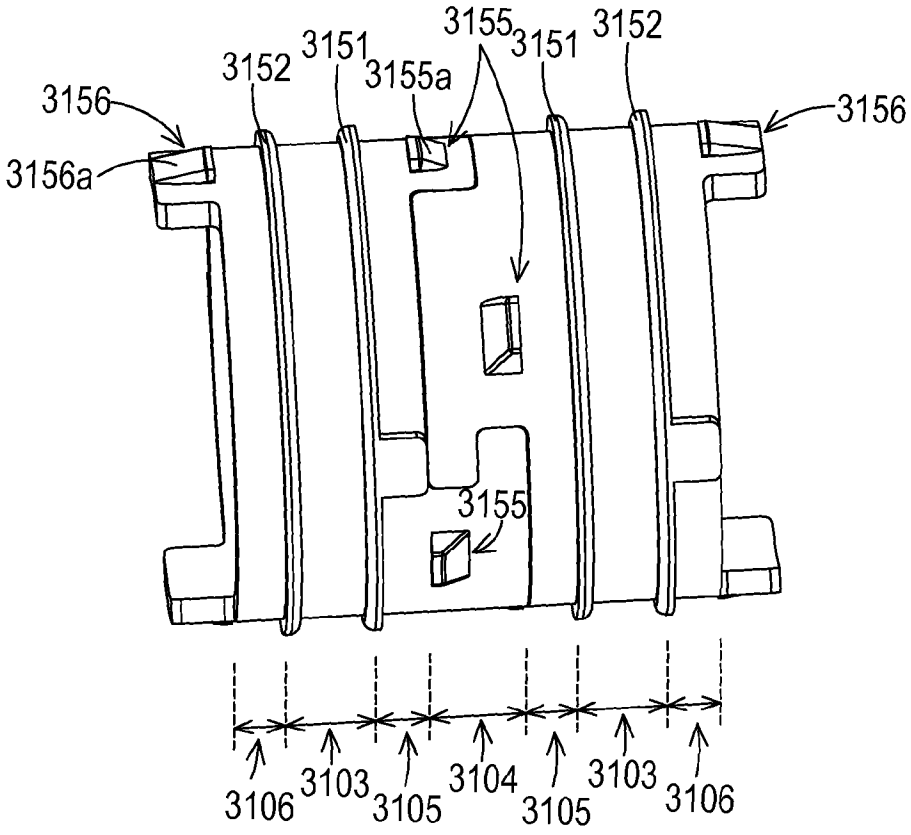
FIG. 3C is a schematic side view illustrating the combination of two bobbin units of the magnetic element as shown in FIG. 3A.

FIG. 3C is a schematic side view illustrating the combination of two bobbin units of the magnetic element as shown in FIG. 3A. As shown in FIG. 3C, plural first bulges 3155 are located at the first lateral part 310*a* of the main body 310, and a first accommodation space 3105 is defined by the plural first bulges 3155 and the first ring-shaped rib 3151. Moreover, plural second bulges 3156 are located at the second lateral part 310*b* of the main body 310, and a second accommodation space 3106 is defined by the plural second bulges 3156 and the second ring-shaped rib 3152. The corresponding pancake winding assemblies 4 are disposed in the first accommodation space 3105 and the second accommodation space 3106. After the two bobbin units 31 are combined together, a second winding section 3104 is defined between the plural first bulges 3155 of one bobbin unit 31 and the plural first bulges 3155 of the other bobbin unit 31. Consequently, the winding coil assembly 5 can be further wound around the second winding section 3104.

Please refer to FIGS. 3B and 3C. The first bulge 3155 has a first slant surface 3155*a*. The first slant surface 3155*a* ascends in the direction from an outer edge of the first lateral part 310*a* to the first ring-shaped rib 3151. The second bulge 3156 has a second slant surface 3156*a*. The second slant surface 3156*a* ascends in the direction from an outer edge of the second lateral part 310*b* to the second ring-shaped rib 3152. The pancake winding assembly 4 may be moved along the first slant surface 3155*a* or the second slant surface 3156*a* so as to be accommodated within the first accommodation space 3105 or the second accommodation space 3106.

Please refer to FIG. 3A again. Preferably (but not exclusively), the pancake winding assembly 4 is used as a secondary winding assembly of a transformer. Moreover, the pancake winding assembly 4 comprises a conductive body 40 and two pins 41. The conductive body 40 has a central opening 401. The conductive body 40 comprises two coiled copper sheets. The two pins 41 are extended downwardly from two ends of the conductive body 40. Moreover, each pancake winding assembly 4 comprises a locking recess 42. Through the locking recess 42, the pancake winding assembly 4 is connected with and positioned by the corresponding bobbin unit 31. The at least one pancake winding assembly 4 comprises a first pancake winding assembly 4*a* and a second pancake winding assembly 4*b*. The first pancake winding assembly 4*a* and the second pancake winding assembly 4*b* are respectively disposed in the first accommodation space 3105 of the first lateral part 310*a* of the bobbin unit 31 and the second accommodation space 3106 of the second lateral part 310*b* of the bobbin unit 31, and coupled with the coupling structure 315. The locking recess 42 of the first pancake winding assembly 4*a* is concavely formed in an inner surface of the conductive body 40 and engaged with the first locking part 3153 of the coupling structure 315. Similarly, the locking recess 42 of the second pancake winding assembly 4*b* is concavely formed in an inner surface of the conductive body 40 and engaged with the second locking part 3154 of the coupling structure 315. In this embodiment, both of the first pancake winding assembly 4*a* and the second pancake winding assembly 4*b* are disposed around the bobbin unit 31. In some other embodiments, only one of the first pancake winding assembly 4*a* and the second pancake winding assembly 4*b* is disposed around the bobbin unit 31. Moreover, the pancake winding assembly 4 further comprises a first connecting part 43. The first connecting part 43 comprises two indentations 431, 432 and a supporting recess 433. The supporting recess 433 is located at top edge of the pancake winding assembly 4. The two indentations 431 and 432 are formed in the top periphery of the pancake winding assembly 4 and symmetrically located at both sides of the supporting recess 433. Moreover, the winding coil assembly 5 may cross over the supporting recess 433 of the first connecting part 43 of the pancake winding assembly 4. In some other embodiments, the two indentations 431, 432 and the supporting recess 433 of the first connecting part 43 correspond to the fixing device 32. The number and the positions of the first connecting part 43 may be varied according to the practical requirements.

Please refer to FIG. 3A again. A process of assembling the second pancake winding assembly 4*b* with the bobbin unit 31 will be illustrated as follows. Firstly, the locking recess 42 of the second pancake winding assembly 4*b* is aligned with the second locking part 3154 of the main body 310 of the bobbin unit 31. Then, the second pancake winding assembly 4*b* is moved along the second slant surface 3156*a* in the direction from the outer edge of the second lateral part 310*b* to the second ring-shaped rib 3152. While the second pancake winding assembly 4*b* is moved along the second slant surface 3156*a*, the plural second bulges 3156 are slightly subjected to deformation. After the second pancake winding assembly 4*b* is moved across the second slant surface 3156*a*, the second pancake winding assembly 4*b* is disposed in the second accommodation space 3106 of the bobbin unit 31. Meanwhile, the second locking part 3154 of the coupling structure 315 is engaged with and received within the locking recess 42 of the second pancake winding assembly 4*b*. Due to the engagement between the second locking part 3154 of the coupling structure 315 and the locking recess 42 of the second pancake winding assembly 4*b*, the second pancake winding assembly 4*b* is not rotated relative to the bobbin unit 31. Moreover, the second ring-shaped rib 3152 and the plural second bulges 3156 of the coupling structure 315 are contacted with bilateral surfaces of the second pancake winding assembly 4*b*. Consequently, the second pancake winding assembly 4*b* is not axially moved relative to the bobbin unit 31. The process of assembling the first pancake winding assembly 4*a* with the bobbin unit 31 is similar to the process of assembling the second pancake winding assembly 4*b* with the bobbin unit 31, and is not redundantly described herein. After the first pancake winding assembly 4*a* is disposed in the first accommodation space 3105 and the second pancake winding assembly 4*b* is disposed in the second accommodation space 3106, the first pancake winding assembly 4*a* and the second pancake winding assembly 4*b* are assembled with the bobbin unit 31.

From the above descriptions, the first pancake winding assembly 4*a* and the second pancake winding assembly 4*b* are respectively disposed in the first accommodation space 3105 of the first lateral part 310*a* of the bobbin unit 31 and the second accommodation space 3106 of the second lateral part 310*b* of the bobbin unit 31 through the coupling structure 315 of the bobbin unit 31. Moreover, even if the first ring-shaped rib 3151, the second ring-shaped rib 3152, the first locking part 3153, the second locking part 3154, the at least one first bulge 3155 and the at least one second bulge 3156 of the coupling structure 315 of the bobbin unit 31 are slightly protruded from the external surface 3101 of the main body 310, the efficacy of securely fixing the first pancake winding assembly 4*a* and the second pancake winding assembly 4*b* will be enhanced. Since the thickness of the wall of the main body 310 is largely reduced, the fabricating cost of the bobbin unit 31 is reduced and the winding space of the bobbin assembly 3 is enlarged.

As shown in FIG. 2, the magnetic core assembly 6 comprises two magnetic cores 6*a* and 6*b*. Each of the two magnetic cores 6*a* and 6*b* comprises a middle leg 61, a base plate 62 and two lateral legs 63. The middle leg 61 is disposed on a middle region of the base plate 62. The two lateral legs 63 are protruded from two opposite ends of the base plate 62. Moreover, the base plate 62 has a concave structure 620 corresponding to the middle leg 61. While the two magnetic cores 6*a* and 6*b* of the magnetic core assembly 6 and the at least one bobbin unit 31 are combined together, the middle legs 61 are accommodated within the channel 3102 of the bobbin unit 31, and the position-limiting structures 314 of the bobbin unit 31 are received within the corresponding concave structures 620 of the base plates 62 (see FIG. 4). Consequently, the magnetic core assembly 6 is not rotated relative to the bobbin assembly 3, and the magnetic core assembly 6 is effectively positioned.

Figure 4:
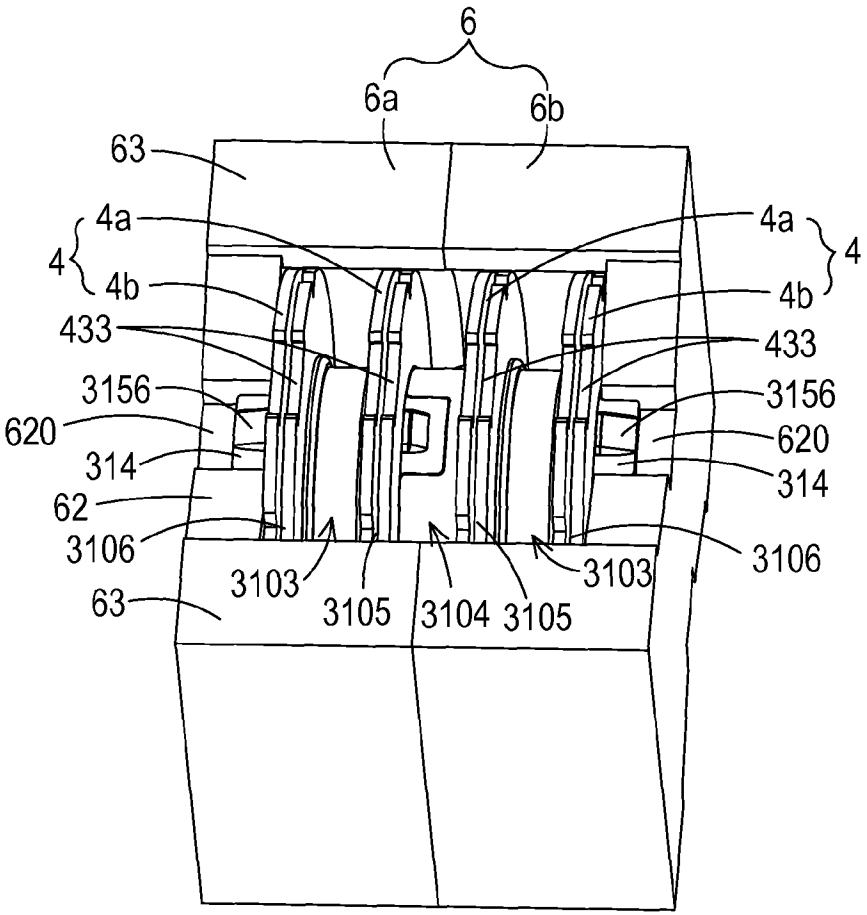
FIG. 4 is a schematic assembled view illustrating the combination of the two bobbin units, the at least one pancake winding assembly and the magnetic core assembly of the magnetic element of FIG. 2.

FIG. 4 is a schematic assembled view illustrating the combination of the two bobbin units, the at least one pancake winding assembly and the magnetic core assembly of the magnetic element of FIG. 2. After the first pancake winding assembly 4*a* is disposed in the first accommodation space 3105 and the second pancake winding assembly 4*b* is disposed in the second accommodation space 3106, the first pancake winding assembly 4*a* and the second pancake winding assembly 4*b* are assembled with the bobbin unit 31. As mentioned above, the arrangements of the first guiding structure 3131 and the second guiding structure 3132 can guide the quick combination of the plural bobbin units 31, so that the process of assembling the bobbin assembly 3 is simplified. Then, the winding coil assembly 5 is sequentially wound around the first winding section 3103 of the bobbin unit 31, crossed over the supporting recess 433 of the first connecting part 43 of the first pancake winding assembly 4*a*, wound around the second winding section 3104, crossed over the supporting recess 433 of the first connecting part 43 of the adjacent first pancake winding assembly 4*a* and wound around the first winding section 3103 of the adjacent bobbin unit 31. After the process of winding the winding coil assembly 5 is completed, the middle legs 61 of the two magnetic cores 6*a* and 6*b* of the magnetic core assembly 6 are accommodated within the channels 3102 of the corresponding bobbin units 31, and the position-limiting structures 314 of the bobbin units 31 are received within the corresponding concave structures 620 of the magnetic cores 6*a* and 6*b*. Meanwhile, the bobbin assembly 3 is covered by the lateral legs 63 of the magnetic cores 6*a* and 6*b*, and thus the magnetic element 2 is assembled.

Figure 1:
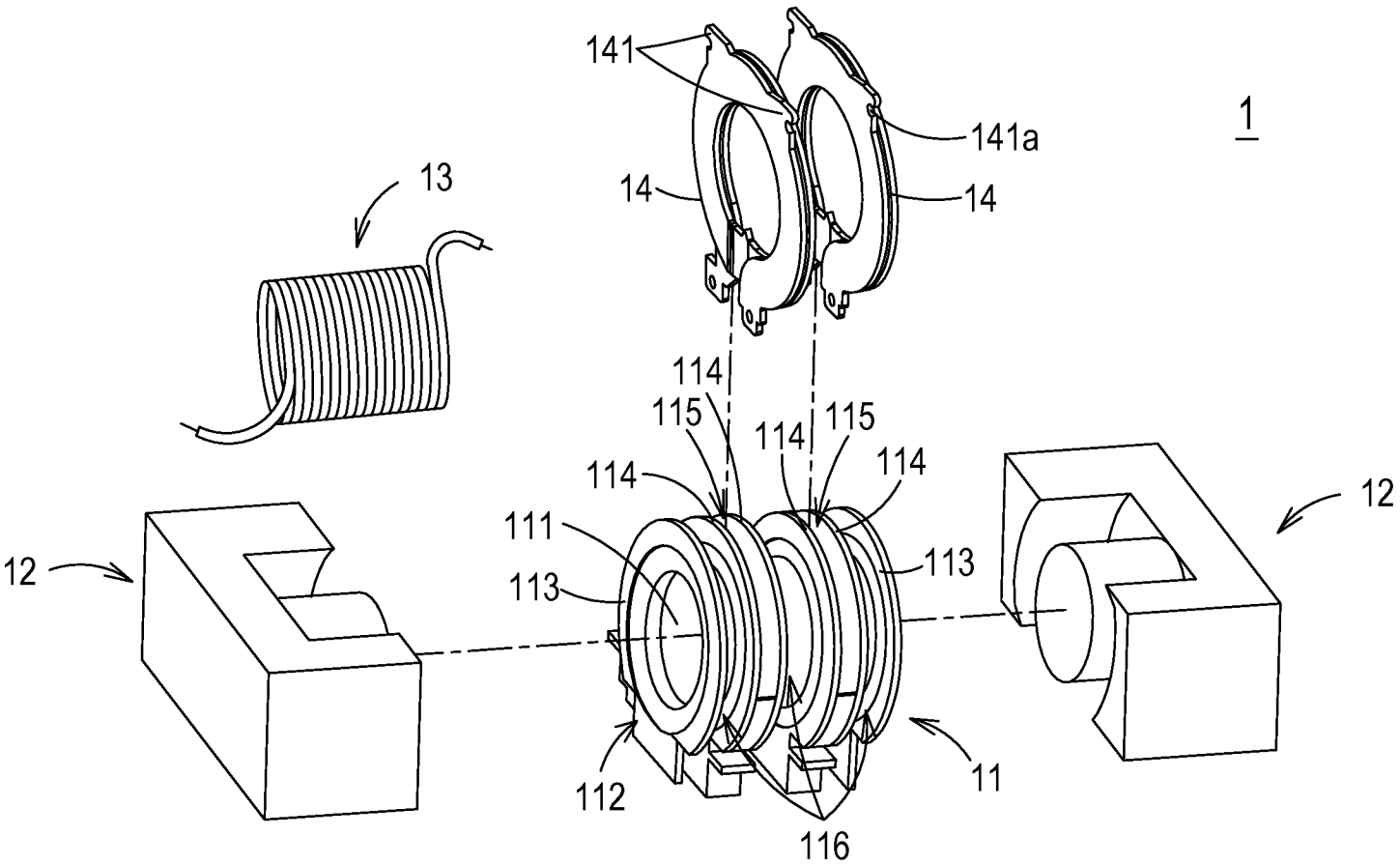
FIG. 1 PRIOR ART
FIG. 1 is a schematic exploded view illustrating a conventional transformer.

Moreover, since the winding coil assembly 5 is wound in a winding space formed by the first pancake winding assembly 4*a*, the second pancake winding assembly 4*b*, the first winding section 3103 and the second winding section 3104, the winding accommodation space 116 defined by the partition plates 114 in the conventional magnetic element of FIG. 1 may be omitted. Consequently, the winding space of the bobbin assembly 3 of the magnetic element 2 is largely increased, and the fabricating cost and the overall volume of the bobbin assembly 3 are reduced.

Figure 5A:
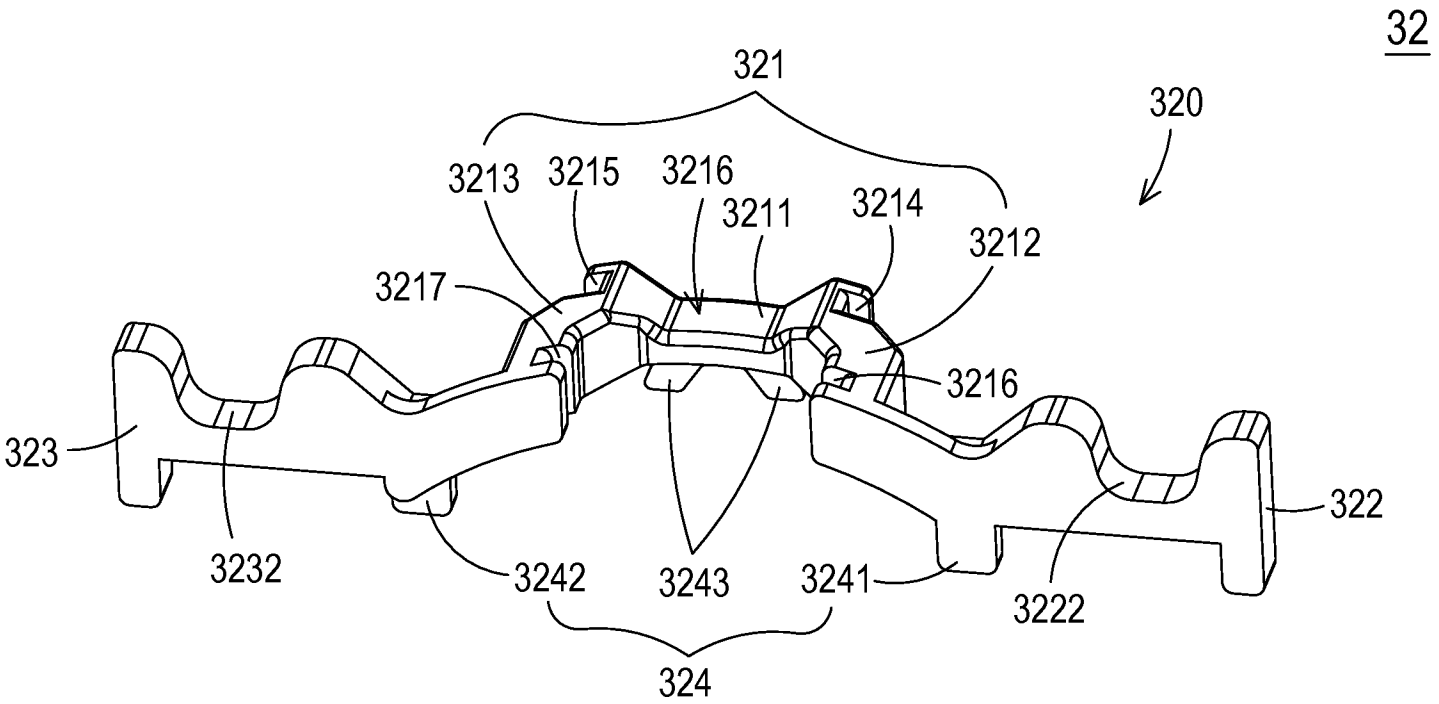
FIG. 5A is a schematic perspective view illustrating a connecting unit of FIG. 2.

FIG. 5A is a schematic perspective view illustrating a connecting unit of FIG. 2. The bobbin assembly 3 further comprises a fixing device 32 for assisting in crossing and fixing the fly lines of the winding coil assembly 5. Preferably, the fixing device 32 is made of an insulation material.

In this embodiment, the fixing device 32 comprises plural connecting units 320. Each connecting unit 320 comprises a connecting body 321, two fixing arms 322, 323 and a second connecting part 324. The two fixing arms 322 and 323 are extended downwardly from two ends of the connecting body 321. The second connecting part 324 comprises two fixing structures 3241, 3242 and two supporting structures 3243. The two fixing structures 3241 and 3242 are disposed on the two fixing arms 322 and 323, and the two supporting structures 3243 are disposed on the connecting body 321. Through the two fixing structures 3241, 3242 and the two supporting structures 3243, the fixing device 32 is connected with the corresponding pancake winding assembly 4.

The connecting body 321 comprises a coil-crossing segment 3211, a first extension segment 3212 and a second extension segment 3213. A first end of the first extension segment 3212 is connected with a first end of the coil-crossing segment 3211, and a second end of the first extension segment 3212 is connected with the fixing arm 322. A first end of the second extension segment 3213 is connected with a second end of the coil-crossing segment 3211, and a second end of the second extension segment 3213 is connected with the fixing arm 323. That is, the coil-crossing segment 3211 is connected between the first extension segment 3212 and the second extension segment 3213. Consequently, the connecting body 321 has an inverted-U shape. Since the first extension segment 3212 and the second extension segment 3213 are slightly higher than the coil-crossing segment 3211, a concave space is defined by the coil-crossing segment 3211, the first extension segment 3212 and the second extension segment 3213. Under this circumstance, the winding coil assembly 5 may cross over the coil-crossing segment 3211.

Figure 6:
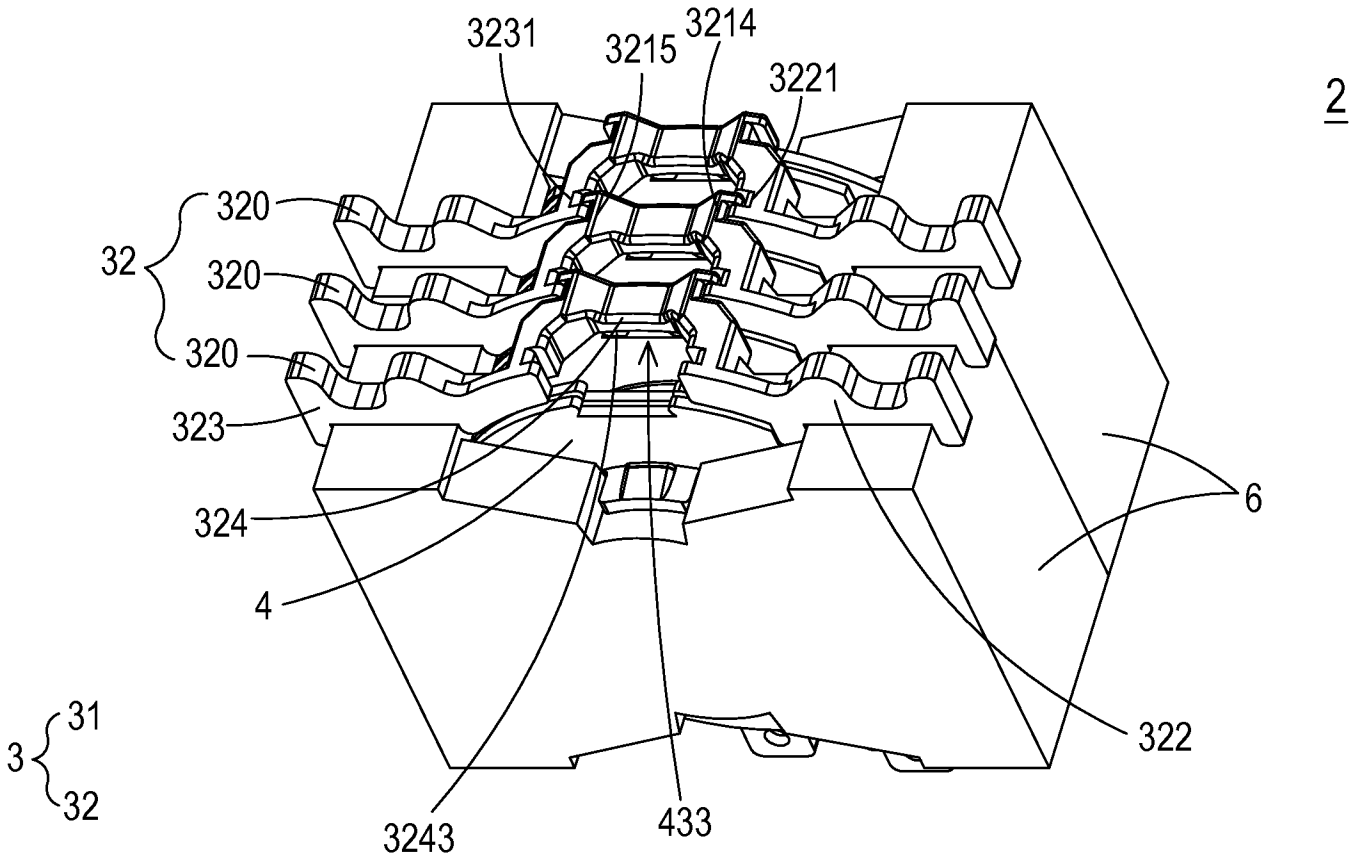
FIG. 6 is a schematic assembled view illustrating the magnetic element of FIG. 2.

The connecting body 321 further comprises two first mating structures 3214, 3215 and two second mating structures 3216, 3217. The first mating structure 3214 is located at the junction between the first extension segment 3212 and the coil-crossing segment 3211. The first mating structure 3215 is located at the junction between the second extension segment 3213 and the coil-crossing segment 3211. The second mating structure 3216 is located at the junction between the fixing arm 322 and the first extension segment 3212. The second mating structure 3217 is located at the junction between the fixing arm 323 and the second extension segment 3213. Moreover, the two first mating structures 3214 and 3215 and the two second mating structures 3216 and 3217 have complementary structures (e.g. convex structures and concave structures). As shown in FIG. 6, the two first mating structures 3214 and 3215 of the connecting unit 320 may be engaged with the two second mating structures 3216 and 3217 of the adjacent connecting unit 320. Consequently, the number of the connecting units 320 of the fixing device 32 can be expanded according to the number of the bobbin units 31.

FIG. 6 is a schematic assembled view illustrating the magnetic element of FIG. 2. Please refer to FIGS. 3A, 5A and 6. The second connecting part 324 comprises the two fixing structures 3241, 3242 and the two supporting structures 3243. The two fixing structures 3241 and 3242 are disposed on the two fixing arms 322 and 323 and correspond to the two indentations 431 and 432 of the first connecting part 43 of the pancake winding assembly 4. The shapes of the two fixing structures 3241 and 3242 match the shapes of the two indentations 431 and 432. Consequently, the two fixing structures 3241 and 3242 may be engaged with the two indentations 431 and 432. The two supporting structures 3243 are disposed on a bottom surface of the coil-crossing segment 3211 of the connecting body 321. The supporting structures 3243 may be engaged with the supporting recess 433 of the first connecting part 43 of the pancake winding assembly 4. It is noted that the types, numbers and positions of the fixing structures and the supporting structures may be varied according to the practical requirements.

Figure 5B:
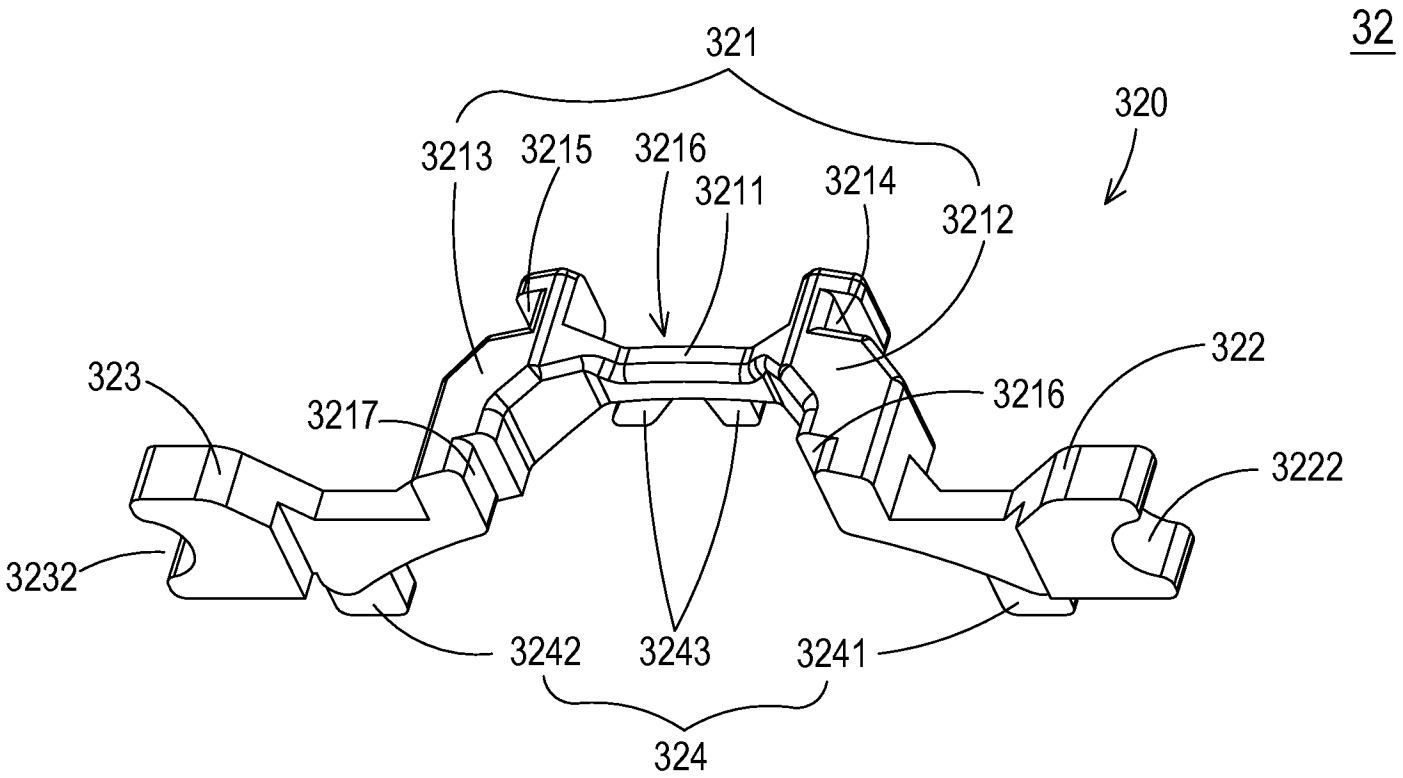
FIG. 5B is a schematic perspective view illustrating a variant example of the connecting unit used in the fixing device of the magnetic element.

As shown in FIG. 5A, two coil-arranging recesses 3222 and 3232 are formed in the two fixing arms 322 and 323, respectively. The coil-arranging recesses 3222 and 3232 may assist in arranging the fly lines of the winding coil assembly 5. In this embodiment, the two coil-arranging recesses 3222 and 3232 are formed in the top surfaces of the two fixing arms 322 and 323, respectively. It is noted that numerous modifications and alterations may be made while retaining the teachings of the disclosure. In a variant example of the connecting unit 320 as shown in FIG. 5B, the two coil-arranging recesses 3222 and 3232 are formed in the lateral distal ends of the two fixing arms 322 and 323, respectively. Moreover, as shown in FIG. 6, the fixing device 32 is disposed over the pancake winding assembly 4. In some other embodiments, the fixing device 32 may be disposed under the pancake winding assembly 4. That is, the position of the fixing device 32 may be determined according to the practical requirements.

Please refer to FIGS. 3A, 5A and 6 again. For assembling the fixing device 32, the two fixing structures 3241 and 3242 of each connecting unit 320 are engaged with the two indentations 431 and 432 of the corresponding pancake winding assembly 4, and the supporting structures 3243 are engaged with the supporting recess 433 of the first connecting part 43 of the corresponding pancake winding assembly 4. Consequently, the plural connecting units 320 are combined with the corresponding pancake winding assemblies 4. In other words, according to the engagement between the second connecting parts 324 of the plural connecting units 320 and the first connecting parts 43 of the pancake winding assemblies 4, the plural connecting units 320 can be securely fixed on the pancake winding assemblies 4. Under this circumstance, the coil-crossing segment 3211 is disposed over the corresponding pancake winding assembly 4 in order to facilitate crossing over the winding coil assembly 5. Moreover, as shown in FIG. 6, portions of the two fixing arms 322 and 323 are disposed over the magnetic core assembly 6. Moreover, the two fixing arms 322 and 323 may clamp the sidewalls of the magnetic cores 6*a* and 6*b* of the magnetic core assembly 6 so as to assist in positioning the magnetic core assembly 6, the bobbing units 31 and the fixing device 32.

In accordance with the present disclosure, the fixing device 32 is used for assisting in crossing over the winding coil assembly 5 and fixing the fly lines of the winding coil assembly 5. Consequently, the drawbacks caused by arrangement of the extension parts 141 of the pancake winding assembly 14 in the conventional magnetic element will be eliminated. In other words, the pancake winding assemblies 4 can be fabricated more simply and more easily because of the arrangement of the fixing device 32. For example, the pancake winding assembly 4 may be easily produced by winding a metallic strip on a jig tool for two turns. Since it is not necessary to weld plural ring-shaped metallic sheets, the process of forming the pancake winding assembly is simplified and the possibility of generating a metal scrap during the fabricating process is minimized. Moreover, since the plural connecting units 320 are combined with the corresponding pancake winding assemblies 4, and the two fixing arms 322 and 323 clamp the magnetic core assembly 6, the structure of the overall magnetic element 2 is very stable. It is noted that numerous modifications and alterations may be made while retaining the teachings of the disclosure. For example, in some other embodiments, the connecting unit 320 only comprises the two fixing arms 322 and 323, wherein the second connecting part 324 is omitted.

Figure 7:
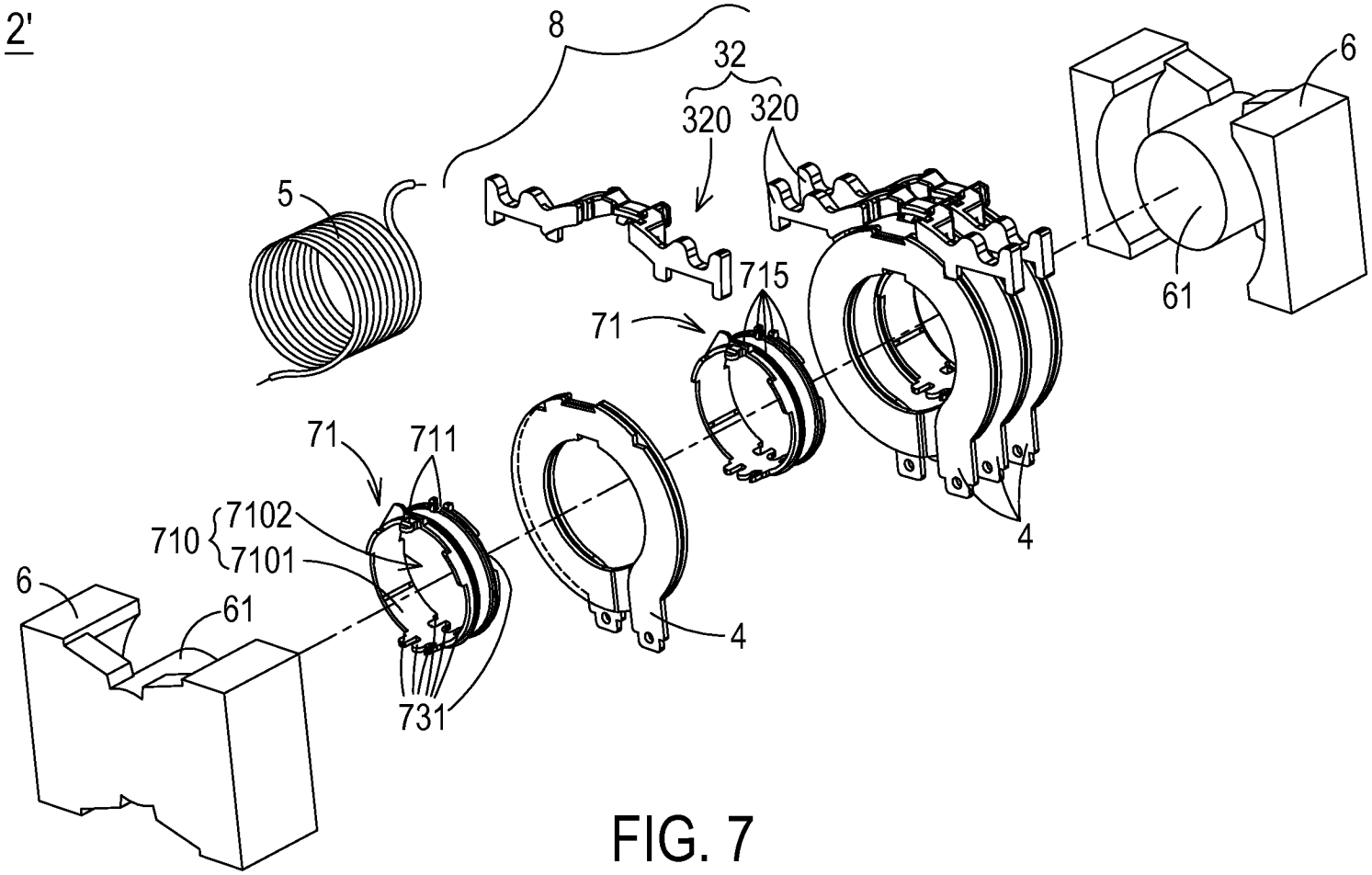
FIG. 7 is a schematic exploded view illustrating a magnetic element according to another embodiment of the present disclosure.

FIG. 7 is a schematic exploded view illustrating a magnetic element according to another embodiment of the present disclosure. As shown in FIG. 7, the magnetic element 2' comprises a bobbin assembly 8 with plural bobbin units 71, at least one pancake winding assembly 4, at least one winding coil assembly 5 and a magnetic core assembly 6. Component parts and elements corresponding to those of the above embodiment are designated by identical numeral references, and detailed descriptions thereof are omitted. In comparison with the magnetic element 2 of FIG. 2, the bobbin units 71 of the bobbin assembly are distinguished.

Figure 9:
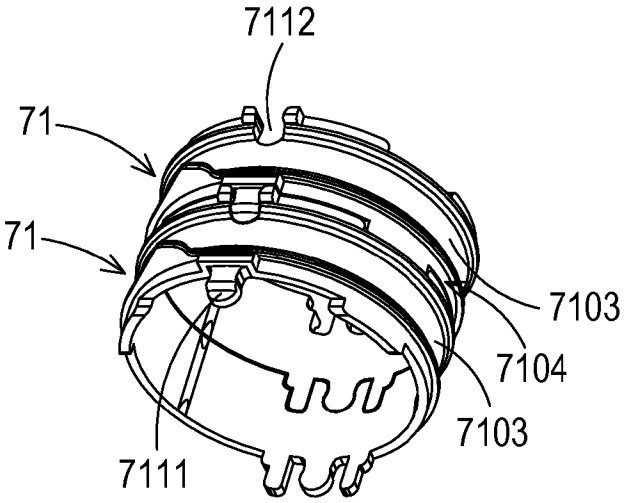
FIG. 9 is a schematic perspective view illustrating the combination of two bobbin units of the bobbin assembly of the magnetic element as shown in FIG. 7.
Figure 8:
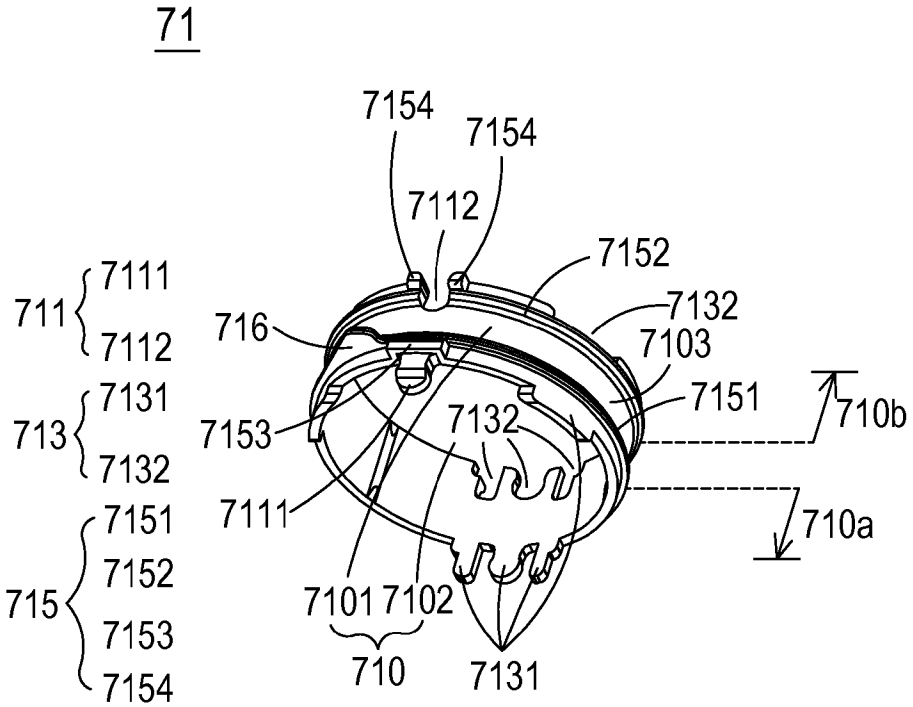
FIG. 8 is a schematic perspective view illustrating a bobbin unit of the bobbin assembly of the magnetic element as shown in FIG. 7.

FIG. 8 is a schematic perspective view illustrating a bobbin unit of the bobbin assembly of the magnetic element as shown in FIG. 7. FIG. 9 is a schematic perspective view illustrating the combination of two bobbin units of the bobbin assembly of the magnetic element as shown in FIG. 7. As shown in FIGS. 7 and 8, each bobbin unit 71 comprises a main body 710, at least one engaging structure 711, at least one guiding structure 713 and a coupling structure 715. In this embodiment, the main body 710 of the bobbin unit 71 has a cylindrical structure with an external surface 7101 and a channel 7102. The coupling structure 715 comprises a first ring-shaped rib 7151 and a second ring-shaped rib 7152. The first ring-shaped rib 7151 and the second ring-shaped rib 7152 are arranged around the external surface 7101 of the main body 710 and in parallel with each other. By the first ring-shaped rib 7151 and the second ring-shaped rib 7152, the external surface 7101 of the main body 710 is divided into a first lateral part 710*a*, a second lateral part 710*b* and the first winding section 7103. In particular, the first winding section 7103 is arranged between the first ring-shaped rib 7151 and the second ring-shaped rib 7152. Consequently, the winding coil assembly 5 may be wound around the first winding section 7103. The first lateral part 710*a* and the second lateral part 710*b* are located at two opposite sides of the first winding section 7103.

As shown in FIG. 8, the at least one engaging structure 711 comprises a first engaging structure 7111 and a second engaging structure 7112. The first engaging structure 7111 is located at the first lateral part 710*a* of the main body 710. The second engaging structure 7112 is located at the second lateral part 710*b* of the main body 710 and opposed to the first engaging structure 7111. In this embodiment, the first engaging structure 7111 is a water-drop-shaped protrusion, and the second engaging structure 7112 is a water-drop-shaped notch (see FIG. 9). After the first engaging structure 7111 of the bobbin unit 71 and the second engaging structure 7112 of an adjacent bobbin unit 71 are engaged with each other, these two bobbin units 71 are combined together. It is noted that the profiles of the first engaging structure 7111 and the second engaging structure 7112 of the bobbin unit 71 are not restricted. Moreover, after the first engaging structure 7111 of the bobbin unit 71 and the second engaging structure 7112 of the adjacent bobbin unit 71 are engaged with each other, the length of the bobbin assembly 8 is extended. Since the length of the bobbin assembly 8 is extensible, it is not necessary to produce a new mold of the bobbin with a corresponding size. Consequently, the fabricating cost of the magnetic element is reduced.

Please refer to FIGS. 8 and 9 again. Moreover, the bobbing unit 71 further comprises at least one guiding structure 713. The at least one guiding structure 713 comprises plural first guiding structures 7131 and plural second guiding structures 7132. The plural first guiding structures 7131 are located at the first lateral parts 710*a* of the main body 710. The plural second guiding structures 7132 are located at the second lateral part 710*b* of the main body 710. The plural first guiding structures 7131 are opposed to the plural second guiding structures 7132 and have complementary shapes to the plural second guiding structures 7132. For example, the plural first guiding structures 7131 are convex structures, and the plural second guiding structures 7132 are concave structures. It is noted that the numbers and shapes of the plural first guiding structures 7131 and plural second guiding structures 7132 are not restricted. In other words, the arrangements of the first guiding structures 7131 and the second guiding structures 7132 can guide the quick combination of the plural bobbin units 71, so that the process of assembling the bobbin assembly 8 is simplified.

Please refer to FIGS. 8 and 9. The coupling structure 715 is configured to be coupled with the pancake winding assembly 4. The coupling structure 715 comprises the first ring-shaped rib 7151, the second ring-shaped rib 7152, a first locking part 7153 and a second locking part 7154. An accommodation space 7104 is defined by the first ring-shaped rib 7151 of the bobbin unit 71 and the second ring-shaped rib 7152 of the adjacent bobbin unit 71. The pancake winding assembly 4 is disposed in the accommodation space 7104. The first locking part 7153 is located at the first lateral part 710*a* of the main body 710, and arranged between the first ring-shaped rib 7151 and the first engaging structure 7111. The second locking part 7154 is located at the second lateral part 710*b* of the main body 710 and arranged at a lateral edge of the second engaging structure 7112. The first locking part 7153 and the second locking part 7154 may be engaged with the pancake winding assembly 4. In this embodiment, the first locking part 7153 is a rectangular block, and the second locking part 7154 comprises two salient points at the two lateral edges of the second engaging structure 7112.

Figure 10B:
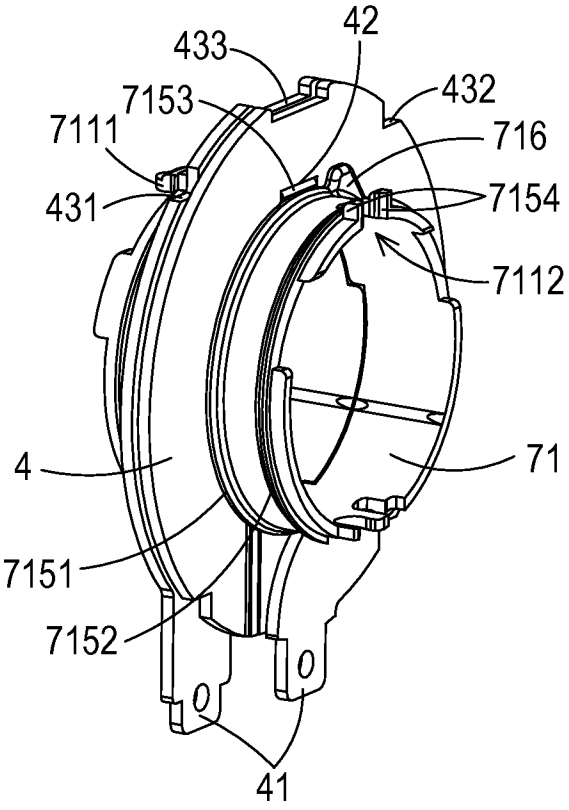
FIG. 10B is a schematic assembled view illustrating the combination of FIG. 10A and taken along another viewpoint.
Figure 10A:
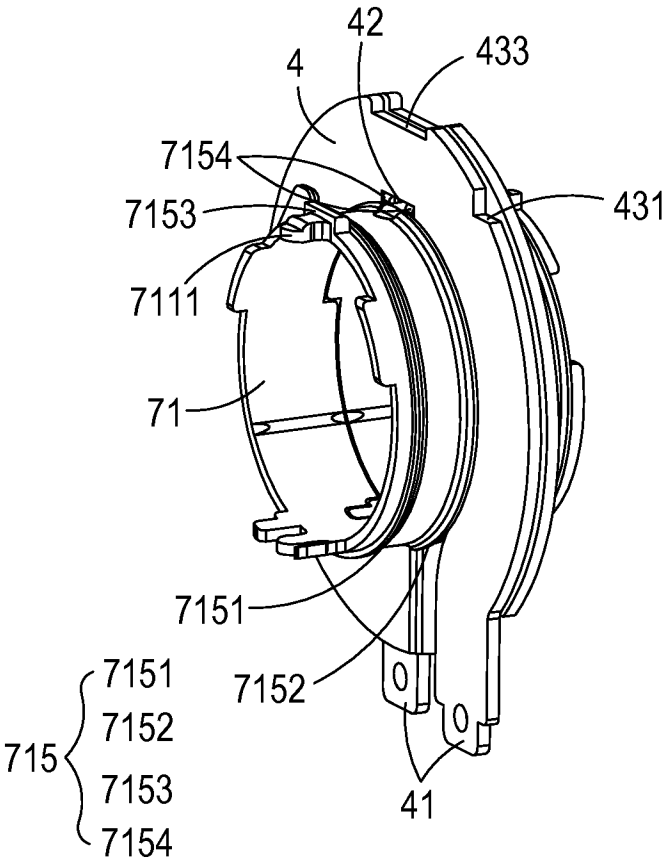
FIG. 10A is a schematic assembled view illustrating the combination of the two bobbin units and the at least one pancake winding assembly of the magnetic element of FIG. 7.

FIG. 10A is a schematic assembled view illustrating the combination of the two bobbin units and the at least one pancake winding assembly of the magnetic element of FIG. 7. FIG. 10B is a schematic assembled view illustrating the combination of FIG. 10A and taken along another viewpoint. Please refer to FIGS. 9, 10A and 10B. The pancake winding assembly 4 is disposed in the accommodation space 7104 and coupled with the coupling structure 715. As mentioned above, each pancake winding assembly 4 comprises a locking recess 42 corresponding to the first locking part 7153 and the second locking part 7154 of the coupling structure 715. When the pancake winding assembly 4 is disposed in the accommodation space 7104 of the bobbin unit 71, the first locking part 7153 of the bobbin unit 71 and the second locking part 7154 of the adjacent bobbin unit 71 are engaged with the locking recess 42 and received within the locking recess 42. Consequently, the pancake winding assembly 4 is not rotated relative to the bobbin unit 71. Moreover, the bilateral surfaces of the pancake winding assembly 4 are contacted with the first ring-shaped rib 7151 of the bobbin unit 71 and the second ring-shaped rib 7152 of the adjacent bobbin unit 71. Consequently, the pancake winding assembly 4 is not axially moved relative to the bobbin unit 71.

Figure 11:
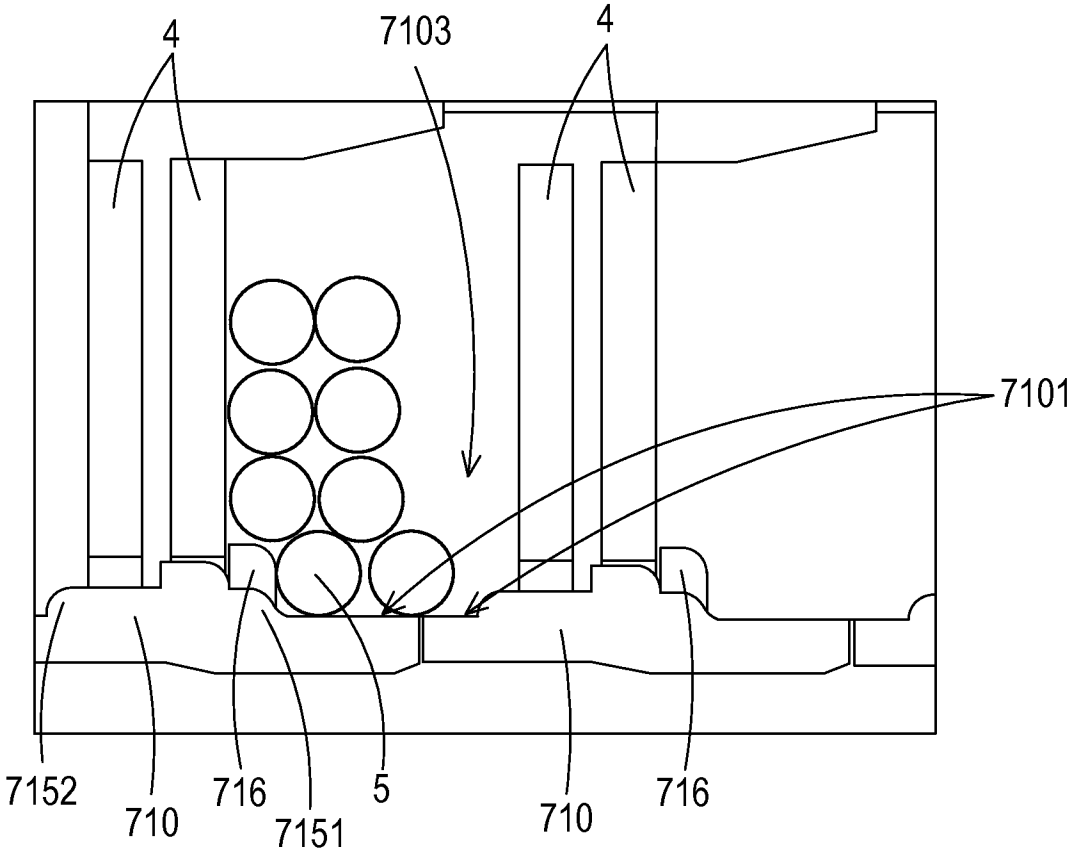
FIG. 11 is a schematic cross-sectional view illustrating a portion of the magnetic element as shown in FIG. 12 and taken along the line yy'.

Please refer to FIGS. 10B and 11. In some embodiments, the bobbin unit 71 further comprises a raised block 716. The raised block 716 is protruded from the first ring-shaped rib 7151. While the winding coil assembly 5 is wound around the first winding section 7103, the winding coil assembly 5 may be wound on the raised block 716. Consequently, the raised block 716 is clamped by and contacted with the winding coil assembly 5 and the pancake winding assembly 4. In other words, the winding coil assembly 5 can be tightly wound around the first winding section 7103 by the raised block 716. It is noted that the type and the position of the raised block 716 are not restricted.

Please refer to FIG. 11 again. The first ring-shaped rib 7151, the second ring-shaped rib 7152 are slightly protruded from the external surface 7101 of the main body 710. Moreover, since the heights of the first ring-shaped rib 7151 and the second ring-shaped rib 7152 are smaller than the diameter of the coil of the winding coil assembly 5, the winding coil assembly 5 cannot be confined within the first winding section 7103. Consequently, the bobbin unit 71 of the present disclosure has neither winding accommodation spaces nor partition plates as shown in FIG. 1.

Figure 12:
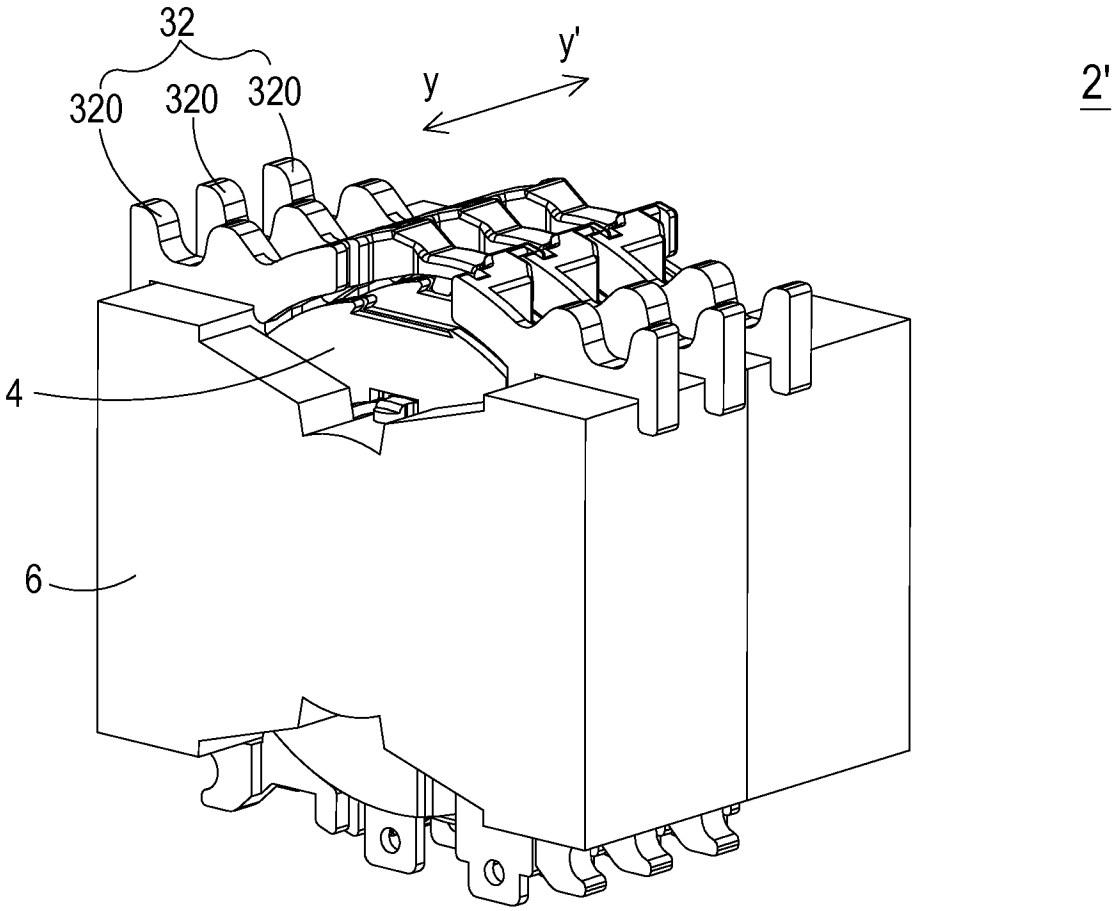
FIG. 12 is a schematic assembled view illustrating the magnetic element of FIG. 7.

Please refer to FIGS. 7, 9 and 12. A process of assembling the magnetic element 2' will be illustrated as follows. Firstly, the first engaging structure 7111 of the bobbin unit 71 and the second engaging structure 7112 of the adjacent bobbin unit 71 are engaged with each other while being guided by the at least one guiding structure 713. Then, the pancake winding assemblies 4 are disposed in the accommodation spaces 7104 of the corresponding bobbin units 71. Then, the plural connecting units 320 of the fixing device 32 are combined with the corresponding pancake winding assemblies 4. Then, the winding coil assembly 5 is wound around the first winding sections 7103 of the bobbin units 71, wherein the winding coil assembly 5 may cross over the connecting units 320. After the magnetic core assembly 6 is embedded into the channels 7102 of the bobbin units 71, the magnetic element 2' is assembled.

From the above descriptions, the present disclosure provides a magnetic element. The magnetic element comprises a bobbin assembly with plural bobbin units, a pancake winding assembly, a winding coil assembly and a magnetic core assembly. Due to the engagement between corresponding engaging structures, every two adjacent bobbin units are combined together. Consequently, the length of the bobbin assembly is extensible according to the practical requirements. Moreover, since the arrangement of the coupling structure can effectively fix the pancake winding assembly, the overall structure of the bobbin assembly is very stable. Moreover, since the bobbin assembly has no partition plates and the coupling structures are slightly protruded from the external surfaces of the bobbin units, the winding space of the bobbin assembly is increased and the overall volume of the magnetic element is reduced. The fixing device is used for assisting in crossing over the winding coil assembly, fixing the fly lines of the winding coil assembly and stabilizing the overall structure of the magnetic element. Consequently, the fabricating cost of the pancake winding assembly is largely reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bobbin assembly for a magnetic element, the magnetic element comprising at least one pancake winding assembly, the bobbin assembly comprising plural bobbin units, wherein the plural bobbin units have no winding accommodation spaces and the plural bobbin units are detachably coupled with each other, wherein each of the plural bobbin units comprises:

a main body comprising an external surface, a channel running through the main body, a first lateral part, a second lateral part opposed to the first lateral part, and a first winding section between the first lateral part and the second lateral part;

a coupling structure disposed on the external surface of the main body, wherein the at least one pancake winding assembly is disposed around the main body of the corresponding bobbin unit, and the at least one pancake winding assembly is coupled with the corresponding coupling structure; and at least one engaging structure, wherein the engaging structure of the bobbin unit is engaged with the engaging structure of the adjacent bobbin unit.

2. The bobbin assembly according to claim 1, wherein the coupling structure comprises a first ring-shaped rib and a second ring-shaped rib, wherein the first ring-shaped rib and the second ring-shaped rib are arranged around the external surface of the main body, wherein the first lateral part, the second lateral part and the first winding section are defined by the first ring-shaped rib and the second ring-shaped rib.

3. The bobbin assembly according to claim 2, wherein the at least one pancake winding assembly is disposed on at least one of the first lateral part and the second lateral part, and the at least one pancake winding assembly is stopped by at least one of the first ring-shaped rib and the second ring-shaped rib.

4. The bobbin assembly according to claim 2, wherein each of the at least one pancake winding assembly comprises a locking recess, and the coupling structure of the bobbin unit comprises a first locking part and a second locking part, wherein the first locking part is located at the first lateral part of the main body and arranged beside the first ring-shaped rib, the second locking part is located at the second lateral part of the main body and arranged beside the second ring-shaped rib, and the first locking part or the second locking part is engaged with the locking recess of the pancake winding assembly.

5. The bobbin assembly according to claim 4, wherein the at least one engaging structure comprises a first engaging structure and a second engaging structure, wherein the first locking part is protruded from the external surface of the main body and arranged between the first ring-shaped rib and the first engaging structure, and the second locking part is protruded from the external surface of the main body and arranged at a lateral edge of the second engaging structure, wherein the first locking part of the bobbin unit and the second locking part of the adjacent bobbin unit are received with the locking recess of the pancake winding assembly.

6. The bobbin assembly according to claim 2, wherein the at least one pancake winding assembly comprises a first pancake winding assembly and a second pancake winding assembly, wherein the first pancake winding assembly is located at the first lateral part of the main body and contacted with the first ring-shaped rib, and the second pancake winding assembly is located at the second lateral part of the main body and contacted with the second ring-shaped rib.

7. The bobbin assembly according to claim 6, wherein the coupling structure of the bobbin unit further comprises plural first bulges and plural second bulges, wherein the plural first bulges are located at the first lateral part of the main body, a first accommodation space is defined by the plural first bulges and the first ring-shaped rib, and the first pancake winding assembly is disposed in the first accommodation space, wherein the plural second bulges are located at the second lateral part of the main body, a second accommodation space is defined by the plural second bulges and the second ring-shaped rib, and the second pancake winding assembly is disposed in the second accommodation space.

8. The bobbin assembly according to claim 7, wherein each of the plural first bulges has a first slant surface, and the first slant surface ascends in a direction from an outer edge of the first lateral part to the first ring-shaped rib, wherein each of the plural second bulges has a second slant surface, and the second slant surface ascends in a direction from an outer edge of the second lateral part to the second ring-shaped rib.

9. The bobbin assembly according to claim 7, wherein a second winding section is arranged between the plural first bulges of the coupling structure of the bobbin unit and the plural first bulges of the coupling structure of the adjacent bobbin unit, wherein the magnetic element further comprises at least one winding coil assembly wound around the second winding section.

10. The bobbin assembly according to claim 2, wherein an accommodation space is defined by the first ring-shaped rib of the bobbin unit and the second ring-shaped rib of the adjacent bobbin unit, and the pancake winding assembly is disposed in the accommodation space.

11. The bobbin assembly according to claim 2, wherein the bobbin unit further comprises a raised block disposed on the first ring-shaped rib, wherein the magnetic element further comprises at least one winding coil assembly wound on the raised block.

12. The bobbin assembly according to claim 1, wherein the at least one engaging structure comprises a first engaging structure and a second engaging structure, wherein the first engaging structure is located at the first lateral part of the main body, and the second engaging structure is located at the second lateral part of the main body and corresponding to the first engaging structure, wherein the first engaging structure of the bobbin unit is engaged with the second engaging structure of the adjacent bobbin unit.

13. The bobbin assembly according to claim 1, wherein each engaging structure is located at the first lateral part of the main body and comprises a protrusion and a notch, wherein the protrusion and the notch of the bobbin unit are engaged with the notch and the protrusion of the adjacent bobbin unit.

14. The bobbin assembly according to claim 1, wherein the bobbing unit further comprises at least one guiding structure, wherein the guiding structure is coupled with the corresponding guiding structure of the adjacent bobbin unit.

15. The bobbin assembly according to claim 14, wherein the at least one guiding structure comprises a first guiding structure and a second guiding structure, wherein the first guiding structure and the second guiding structure are located at the first lateral part of the main body and opposed to each other, wherein the first guiding structure and the second guiding structure of the bobbin unit are respectively coupled with the second guiding structure and the first guiding structure of the adjacent bobbin unit.

16. The bobbin assembly according to claim 14, wherein the at least one guiding structure comprises a first guiding structure and a second guiding structure, wherein the first guiding structure is located at the first lateral parts of the main body, and the second guiding structure is located at the second lateral part of the main body, wherein the first guiding structure of the bobbin unit is coupled with the second guiding structure of the adjacent bobbin unit.

17. The bobbin assembly according to claim 1, wherein the bobbin unit further comprises a position-limiting structure located at the second lateral part of the main body, wherein the magnetic element further comprises a magnetic core assembly positioned by the position-limiting structure.

18. The bobbin assembly according to claim 1, wherein the at least one pancake winding assembly further comprises a first connecting part, the bobbin assembly further comprises a fixing device, and the fixing device comprises plural connecting units, wherein each connecting unit comprises a connecting body, two fixing arms and a second connecting part, wherein the two fixing arms are extended from two ends of the connecting body, and the second connecting part is connected with the first connecting part of the at least one pancake winding assembly.

19. The bobbin assembly according to claim 18, wherein the connecting body of the connecting unit comprises a coil-crossing segment, a first extension segment and a second extension segment, wherein a first end of the first extension segment is connected with a first end of the coil-crossing segment and a second end of the first extension segment is connected with one of the fixing arms, wherein a first end of the second extension segment is connected with a second end of the coil-crossing segment, and a second end of the second extension segment is connected with the other one of the fixing arms, wherein the magnetic element comprises a winding coil assembly cross over the coil-crossing segment of the connecting unit.

20. The bobbin assembly according to claim 19, wherein the first connecting part of the pancake winding assembly comprises a supporting recess, and the second connecting part of the connecting unit comprises a supporting structure, wherein the supporting structure is disposed on the coil-crossing segment of the connecting body of the connecting unit and engaged with the supporting recess of the first connecting part of the pancake winding assembly.

21. The bobbin assembly according to claim 18, wherein the first connecting part of the pancake winding assembly comprises two indentations, and the second connecting part of the connecting unit comprises two fixing structures, wherein the two fixing structures are disposed on the two fixing arms and engaged with the two indentations of the first connecting part of the pancake winding assembly.

22. The bobbin assembly according to claim 18, wherein the connecting body of the connecting unit comprises two first mating structures and two second mating structures corresponding to the two first mating structures, wherein the two first mating structures of the connecting unit are engaged with the two second mating structures of the adjacent connecting unit.

23. The bobbin assembly according to claim 18, wherein a magnetic core assembly of the magnetic element is clamped by the two fixing arms.

24. The bobbin assembly according to claim 18, wherein two coil-arranging recesses are formed in the two fixing arms, respectively.

25. The bobbin assembly according to claim 18, wherein the connecting unit is made of an insulation material.

26. The bobbin assembly according to claim 1, wherein the pancake winding assembly further comprises a first connecting part, and the bobbin assembly further comprises a fixing device, and the fixing device comprises plural connecting units, wherein each connecting unit comprises a connecting body and two fixing arms, wherein the two fixing arms are extended from two ends of the connecting body to clamp a magnetic core assembly of the magnetic element.

27. A magnetic element, comprising:

a bobbin assembly comprising plural bobbin units, wherein the plural bobbin units have no winding accommodation spaces and the plural bobbin units are detachably coupled with each other, wherein each of the plural bobbin units comprises a main body, a coupling structure and at least one engaging structure, wherein the main body comprises an external surface, a channel running through the main body, a first lateral part, a second lateral part opposed to the first lateral part, and a first winding section between the first lateral part and the second lateral part, wherein the coupling structure is disposed on the external surface of the main body, wherein the engaging structure of the bobbin unit is engaged with the engaging structure of the adjacent bobbin unit;

at least one pancake winding assembly disposed around the main body of the corresponding bobbin unit, wherein the at least one pancake winding assembly is coupled with the corresponding coupling structure;

at least one winding coil assembly wound around the first winding section; and a magnetic core assembly partially accommodated within the channel of the bobbin unit.

* * * * *